United States Patent [19]

Koffler

[11] Patent Number: 4,480,351

[45] Date of Patent: Nov. 6, 1984

[54] TWO-COMPONENT SCRUB BRUSH

[75] Inventor: Thomas Koffler, Willowdale, Canada

[73] Assignee: Innovative Molding Technology Inc. (Imtech), Bolton, Canada

[21] Appl. No.: 445,936

[22] Filed: Dec. 1, 1982

[51] Int. Cl.[3] ..... A46B 3/04; A46B 9/02

[52] U.S. Cl. ..... 15/187; 15/167 B; 15/106; 15/DIG. 5; 15/DIG. 6; 525/98; 525/314

[58] Field of Search ..... 15/186, 187, 188, 159 R, 15/159 A, 167 R, 167 A, 160, 106, DIG. 5, DIG. 6; 525/314, 98

[56] References Cited

U.S. PATENT DOCUMENTS

| | | | |
|---|---|---|---|
| 3,133,546 | 5/1964 | Dent | 15/187 X |
| 3,459,830 | 8/1969 | Legge | 525/261 X |
| 3,843,991 | 10/1974 | Vallis | 15/187 X |
| 4,050,825 | 9/1977 | Stein | 15/106 X |

*Primary Examiner*—Peter Feldman

*Attorney, Agent, or Firm*—Karl F. Ross; Herbert Dubno

[57] ABSTRACT

A scrub brush, especially one used for surgical purposes, has a body of polyethylene molded onto a set of bristles made of a thermoplastic rubber such as a styrene/butadiene/styrene block copolymer. The body is integral with a set of stiffer polyethylene bristles, serving mainly for fingernail cleaning, which may be disposed on the side opposite the softer elastomeric bristles or flanked by the latter.

12 Claims, 4 Drawing Figures

TWO-COMPONENT SCRUB BRUSH

FIELD OF THE INVENTION

My present invention relates to a scrub brush of the type used, for example, by surgeons and staff of hospitals and other health-care facilities.

BACKGROUND OF THE INVENTION

A surgical scrub brush of the general type here contemplated is known from U.S. Pat. No. 3,447,181 to Coker et al. According to that patent, an injection-molded brush body comprises a set of bristles integral with a U-shaped backing which may be used as a handle. A sponge of open-cell polyurethane foam is bonded onto the backing, on the side opposite the bristles, and is impregnated with surgical detergent. The patentees mention polyethylene as the preferred material for molding the brush body.

It is also known to provide a detergent-impregnated pad with bristles directly projecting from one of its major surfaces; see U.S. Pat. No. 3,392,421 to Mathison.

In commonly owned U.S. patent application Ser. No. 309,041 filed Sept. 28, 1981 by Joseph Vallis, now abandoned and replaced by application Ser. No. 445,856 filed Dec. 1, 1982 there has been disclosed a disposable brush for surgical purposes wherein a bristle-carrying base element or handle portion forms a compartment for soap, the base element having perforations through which dissolved soap may pass to the bristles to form suds. That application also teaches the use of a thermoplastic rubber, specifically a styrene/butadiene copolymer available under the trademark KRATON, as the preferred material for the brush body whose interaction with the soap has been found to promote foaming.

Two earlier patents by the same Joseph Vallis, U.S. Pat. Nos. 3,744,078 and 3,843,991, disclose and claim a nail brush whose bristles are of different lengths so as to define a cleaning face with a longitudinal groove and transverse depressions, the groove accommodating the tip of a finger whose nail is to be cleaned. The bristles are described as consisting of a synthetic plastic material which may or may not be the same as that used for their backing element.

OBJECT OF THE INVENTION

The object of my present invention is to provide an improved scrub brush, usable for both surface and fingernail cleaning, designed to satisfy the most exacting requirements of surgeons and other medical personnel.

SUMMARY OF THE INVENTION

I have found, in accordance with my present invention, that this object can be attained by providing a scrub brush with two different sets of bristles, namely a first set of a relatively hard polymeric material and a second set of a relatively soft elastomeric material, carried on a common body serving as a handle.

For structural rigidity, the body should also consist of a relatively hard material—preferably a lower polyolefin such as polyethylene—and is therefore best made integral with the first set of bristles. The bristles of the second set may be integral with a backing of the same relatively soft material adhering to the harder brush body, as by being conjointly molded therewith.

The two sets of bristles may be disposed on opposite sides of the body; if they are mounted on the same side, the harder bristles of the first set are preferably disposed in a gap separating two groups of bristles of the second set and, advantageously, have tips recessed from those of the latter set; some of these tips should be laterally accessible for nail cleaning. Thus, the brush may have a structure somewhat similar to that shown in the above-identified Vallis patents but with the significant difference that the shorter bristles are harder than the longer ones.

Pursuant to a more particular feature of my invention, the relatively soft elastomeric material is a thermoplastic rubber having the foam-promoting properties described in the commonly owned Vallis application Ser. No. 309,041, namely a block copolymer of the form A-B-A wherein A is a polymerized mono-alpha-alkenyl arene and B is a polymerized conjugated diene as disclosed in U.S. Pat. No. 3,459,830 to Legge et al. This latter patent is representative of a number of such patents assigned to Shell Oil Company which relate to the material sold by that company under the aforementioned trademark KRATON. The preferred block copolymer of that class has the styrene-butadiene-styrene (SBS) configuration and, as marketed under the designation KRATON 3226, is characterized by a modulus of elasticity differing from that of the hitherto favored polyethylene by a ratio of almost 1:200. Though other materials of this class could also be used, the ratio between the elastic moduli of the soft and hard polymers should be at least 1:100 in order to provide, on the one hand, the high degree of resiliency instrumental in suds formation and, on the other hand, the stiffness needed for fingernail cleaning. Though styrene-butadiene rubber has been listed in British Pat. No. 1,446,050 as one of several polar high-molecular-weight materials suitable for stain removal, I am not aware of any prior publication suggesting its use as an enhancer for soap suds or the like.

BRIEF DESCRIPTION OF THE DRAWING

The above and other features of my invention will now be described in detail with reference to the accompanying drawing in which.

SPECIFIC DESCRIPTION

Figure 1:
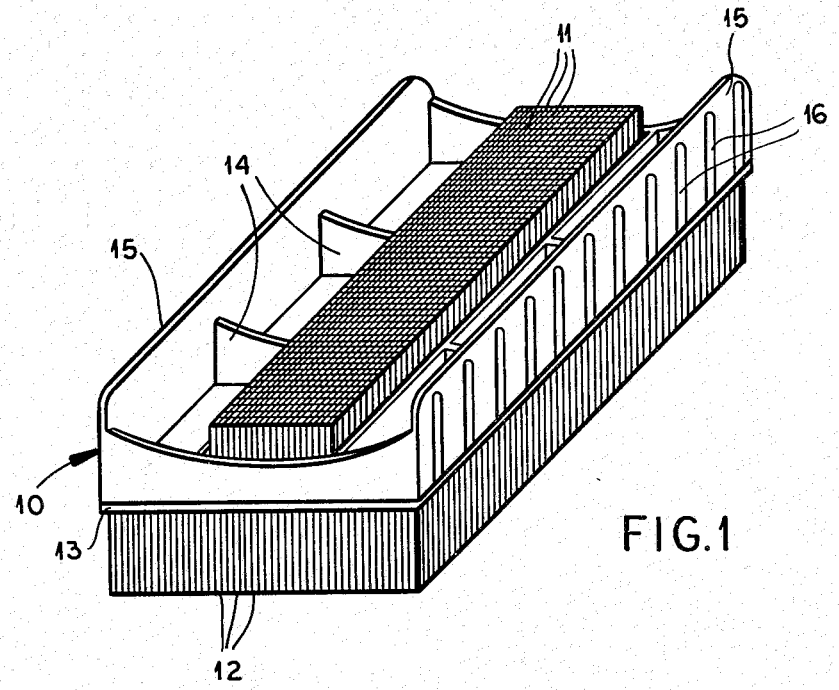
FIG. 1 is a perspective view of a two-component scrub brush embodying my invention.

FIG. 1 shows a brush according to my invention comprising a body 10 of relatively hard polymeric material, such as polyethylene, integral with a set of bristles 11 of the same material rising from a rear surface thereof. Another set of bristles 12 of relatively soft elastomeric material, such as a polystyrene-polybutadiene-polystyrene (SBS) block copolymer, is integral with a backing 13 of the same material bonded onto the body 10 on its front side. The entire brush can be molded in one piece with the aid of separate mold-cavity inserts for a first-shot and a second-shot injection as is well known per se.

While the bristles 12 occupy the entire area of one of the major surfaces of a rectangular plate constituting the main part of body 10, bristles 11 are confined to a limited central zone of such area and are spaced by transverse webs 14 from lateral flanges 15 of that body which have outer ribs 16 to provide a firmer grip. The stiffness of bristles 11, whose outer rows have laterally accessible tips, makes them ideal for the cleaning of fingernails whereas the flexibility of bristles 12 and the aforedescribed properties of thermoplastic rubber—especially that of the SBS type—promotes the foaming of soap solution in the scrubbing of, say, a surgeon's hands and arms.

Figure 2:
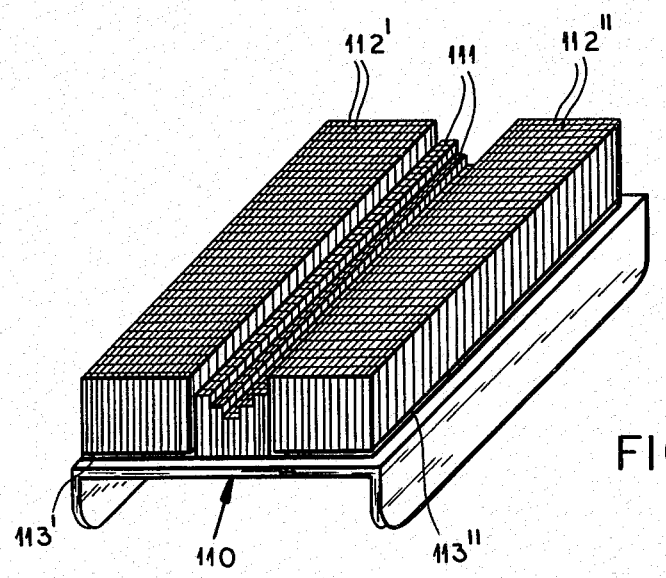
FIG. 2 is a view similar to FIG. 1, showing a modification.
Figure 3:
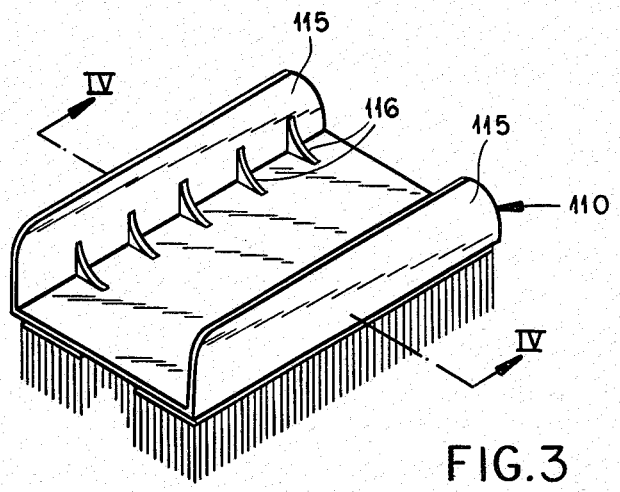
FIG. 3 is a perspective view of the brush of FIG. 2 seen in a reversed position.
Figure 4:
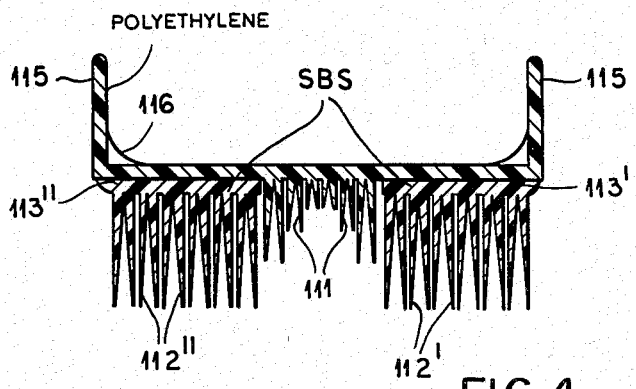
FIG. 4 is a cross-sectional view taken on the line IV—IV of FIG. 3.

FIGS. 2, 3 and 4 show another brush according to my invention with a body 110 of polyethylene, a set of relatively hard bristles 111 of the same material integral with that body and two groups of relatively soft bristles 112', 112" of SBS block copolymer integral with respective backings 113', 113" of like elastomeric material. Bristles 111 are disposed in a longitudinal channel or gap between bristle groups 112' and 112" and, in fact, have staggered tips defining rows of different height along which some of these tips are laterally exposed (as in the preceding embodiment) to facilitate nail cleaning. The reverse side of body 110 has upstanding flanges 115 braced against the plate-shaped central part of that body by webs 116; the flanges could again be provided with outer ribs such as those indicated at 16 in FIG. 1.

Tests have shown that an SBS bristle of triangular cross-section with a length of 12.7 mm, tapering to a point from a root whose isosceles profile is defined by a base of 1.52 mm and a height of 0.76 mm, has a longitudinal modulus of elasticity of 3964 kilopascals (KPa) compared with a value of 758,423 KPa for a polyethylene bristle of the same shape. This means that a force of only 0.23 gram is required to deflect the tip of the bristle (taken as a cantilevered beam) for a distance of half its length, i.e. 6.35 mm, as against a force of 39.7 grams for a corresponding polyethylene bristle.

I claim:

1. A scrub brush comprising a body, a first set of bristles of a relatively hard polymeric material on said body, and a second set of bristles of a relatively soft elastomeric material on said body, said relatively soft material being a block copolymer of the form A-B-A, A being a polymerized mono-alpha-alkenyl arene, B being a polymerized conjucated diene, said relatively hard material being a lower polyolefin, said relatively soft and relatively hard material having moduli of elasticity differing by a ratio of at least 1:100 at room temperature.

2. A scrub brush as defined in claim 1 wherein said body consists of said relatively hard polymeric material and is integral with said first set of bristles.

3. A scrub brush as defined in claim 2 wherein said first and second sets of bristles project from opposite sides of said body.

4. A scrub brush as defined in claim 2 wherein said second set of bristles is divided into two groups separated by a gap, said first set of bristles being disposed in said gap.

5. A scrub brush as defined in claim 4 wherein the bristles of said first set have tips recessed from those of the bristles of said second set.

6. A scrub brush as defined in claim 1 wherein said block copolymer has the configuration polystyrene-polybutadiene-polystyrene.

7. A scrub brush as defined in claim 1 wherein said relatively hard material is polyethylene.

8. A scrub brush as defined in claim 1 wherein said block copolymer has the configuration polystyrene-polybutadiene-polystyrene, said relatively hard material being polyethylene.

9. A scrub brush as defined in claim 2 wherein the bristles of said second set are integral with a backing of said relatively soft elastomeric material adhering to said body.

10. A scrub brush as defined in claim 9 wherein said body comprises a flat plate, said backing overlying the greater part of the area of a major surface of said plate, said first set of bristles being confined to a limited zone of said area.

11. A scrub brush as defined in claim 1 wherein some of the bristles of said first set have laterally exposed tips facilitating the cleaning of fingernails.

12. A scrub brush as defined in claim 11 wherein the bristles of said first set are inserted in rows of different height between bristles of said second set.

* * * * *